US006971480B2

(12) United States Patent
Trifu

(10) Patent No.: US 6,971,480 B2
(45) Date of Patent: Dec. 6, 2005

(54) ELEVATOR COMMUNICATION DEVICES, SYSTEMS AND METHODS

(75) Inventor: Victor Trifu, Mastic Beach, NY (US)

(73) Assignee: Electronic Micro Systems Inc., Hauppauge, NY (US)

( * ) Notice: Subject to any disclaimer, the term of this patent is extended or adjusted under 35 U.S.C. 154(b) by 242 days.

(21) Appl. No.: 10/652,865

(22) Filed: Aug. 29, 2003

(65) Prior Publication Data

US 2005/0045425 A1 Mar. 3, 2005

(51) Int. Cl.[7] ..... B66B 1/28
(52) U.S. Cl. ..... 187/247; 187/391
(58) Field of Search ..... 187/247, 248, 187/391–396

(56) References Cited

U.S. PATENT DOCUMENTS

| | | | | |
|---|---|---|---|---|
| 3,782,504 A | * | 1/1974 | Billmaier et al. | 187/380 |
| 3,883,695 A | * | 5/1975 | Bickel et al. | 379/40 |
| 4,113,986 A | | 9/1978 | Clement et al. | |
| 4,459,434 A | | 7/1984 | Benning et al. | |
| 4,554,411 A | | 11/1985 | Armstrong | |
| 4,764,953 A | | 8/1988 | Chern et al. | |
| 4,937,855 A | | 6/1990 | McNab et al. | |
| 4,987,589 A | | 1/1991 | Trell | |
| 5,046,083 A | | 9/1991 | Trell | |
| 5,086,450 A | | 2/1992 | Kitagawa et al. | |
| 5,131,508 A | | 7/1992 | Suzuki | |
| 5,321,742 A | | 6/1994 | Stevens | |
| 5,345,046 A | | 9/1994 | Rynaski et al. | |
| 5,445,245 A | | 8/1995 | Ketoviita | |
| 5,714,726 A | | 2/1998 | Ketoviita | |
| 5,736,694 A | | 4/1998 | Ketoviita | |
| 5,784,446 A | | 7/1998 | Stuart | |
| 6,185,294 B1 | | 2/2001 | Chornenky et al. | |

* cited by examiner

*Primary Examiner*—Jonathan Salata
(74) *Attorney, Agent, or Firm*—Dinsmore & Shohl LLP

(57) ABSTRACT

A device for facilitating communications between an elevator passenger and a person outside of the elevator through use of an elevator telephone. The device includes a service port configured for connection to a telephone company feed line and an elevator telephone port configured for connection to an elevator telephone. The elevator telephone port is selectively coupled with the service port through a first switch that is configured to isolate the service port from the elevator telephone port upon receiving a first signal. A supervisor port is configured for connection to a supervisor telephone. A second switch is configured to facilitate electrical coupling between the elevator telephone port and the supervisor port upon receiving a second signal. A control circuit is configured to provide the first and second signals in response to an activation command, and a ring circuit is configured, as directed by the control circuit, to cause an elevator telephone connected to the elevator telephone port to ring. An elevator system and a method are also provided.

38 Claims, 6 Drawing Sheets

ELEVATOR COMMUNICATION DEVICES, SYSTEMS AND METHODS

TECHNICAL FIELD

The present invention relates to an intercom system for facilitating voice intercommunication between an elevator passenger and a person outside of the elevator through use of an existing elevator telephone. The person outside of the elevator might, for example, be an elevator maintenance supervisor present in the elevator machine control room.

BACKGROUND OF THE INVENTION

It is common for a multi-story building to incorporate one or more passenger elevator systems that are configured to transport passengers between different elevational floors of the building. A passenger elevator system typically includes an elevator that is suspended by overhead cables or is supported by one or more underlying hydraulic cylinders. Such elevators typically include an elevator telephone that enables elevator passengers to contact one or more persons outside of the elevator, such as in the event of an emergency. Accordingly, in one conventional configuration, when an elevator passenger uses the elevator telephone to initiate a call, this call is routed through a feed line to the telephone company. The telephone company then connects the called party and facilitates the conversation between the elevator passenger and the called party.

In such a system, if the feed line is severed or malfunctions, the elevator passenger is rendered unable to communicate through use of the elevator telephone, and might accordingly be left without any means for seeking assistance. For this and additional reasons, it is desirable for such passenger elevators to be equipped with an intercom system in order that an elevator passenger can speak with local elevator attendants (e.g., in the elevator machine control room) without use of the feed line. Although certain conventional intercom systems not involving the elevator telephone can be installed into an existing elevator system, such intercom systems are typically cost-prohibitive and/or require excessive amounts of labor for installation. Other conventional intercom systems involving the elevator telephone (e.g., telephone multiplexers) are typically complex, expensive and are unable to ensure access of the elevator telephone to the feed line when intercom communications are inactive, hence creating a risk that an elevator passenger would under certain circumstances be rendered unable to call for help.

Accordingly, there is a need for simple and inexpensive devices, systems and methods for enabling an existing elevator telephone to selectively facilitate voice communications between an elevator passenger and a person outside of the elevator without use of the telephone company feed line. There is a further need for such devices, systems and methods to ensure that the elevator telephone retains access to the feed line while intercom communications are inactive.

SUMMARY OF THE INVENTION

Accordingly, it is an aspect of the present invention to provide simple and inexpensive devices, systems and methods for enabling an existing elevator telephone to selectively facilitate voice communications between an elevator passenger and a person outside of the elevator without use of the telephone company feed line for those communications. It is a further aspect of the present invention for such devices, systems and methods to ensure that the elevator telephone retains access to the feed line while intercom communications are inactive.

To achieve the foregoing and other aspects, and in accordance with the purposes of the present invention defined herein, a device is provided for facilitating communications between an elevator passenger and a person outside of the elevator through use of an elevator telephone. The device includes a service port configured for connection to a telephone company feed line and an elevator telephone port configured for connection to an elevator telephone. The elevator telephone port is selectively coupled with the service port through a first switch that is configured to isolate the service port from the elevator telephone port upon receiving a first signal. A supervisor port is configured for connection to a supervisor telephone. A second switch is configured to facilitate electrical coupling between the elevator telephone port and the supervisor port upon receiving a second signal. A control circuit is configured to provide the first and second signals in response to an activation command, and a ring circuit is configured, as directed by the control circuit, to cause an elevator telephone connected to the elevator telephone port to ring.

In another aspect of the present invention, a device is provided for facilitating communications between an elevator passenger at an elevator telephone and a person outside of the elevator at a microphone/speaker pair. The device includes a service port configured for connection to a telephone company feed line and an elevator telephone port configured for connection to an elevator telephone. The elevator telephone port is selectively coupled with the service port by a first switch that is configured to isolate the service port from the elevator telephone port upon receiving a first signal. A second switch is configured to facilitate electrical coupling between the elevator telephone port and a microphone/speaker pair upon receiving a second signal, and a control circuit is configured to provide the first and second signals in response to an activation command. A ring circuit is configured, as directed by the control circuit, to generate a ring signal for ringing an elevator telephone connected to the elevator telephone port.

In yet another aspect of the present invention, an elevator system is provided that includes an elevator having a telephone selectively connected to a telephone company feed line through a communication device. The communication device is further connected to a supervisor telephone and includes a first switch configured to electrically isolate the elevator telephone from the feed line upon receiving a first signal. The communication device further includes a second switch configured to facilitate electrical coupling between the elevator telephone and the supervisor telephone upon receiving a second signal, a control circuit configured to provide the first and second signals in response to an activation command, and a ring circuit configured, as directed by the control circuit, to cause the elevator telephone to ring.

In still another aspect of the present invention, a method is provided for facilitating communications between an elevator passenger and a person outside of the elevator through use of an elevator telephone, wherein the elevator telephone is connected to a telephone company feed line. The method includes receiving an activation command from the person outside of the elevator, isolating the elevator telephone from the feed line in response to the activation command, connecting the elevator telephone with an RDI line in response to the activation command, and providing a ring signal to the elevator telephone over the RDI line upon connection of the elevator telephone with the RDI line.

In another aspect of the present invention, a device is provided for facilitating communications between an elevator passenger and a person outside of the elevator through use of an elevator telephone. The device includes a service port configured for connection to a telephone company feed line and an elevator telephone port configured for connection to an elevator telephone. The elevator telephone port is selectively electrically coupled with the service port through a means for isolating the service port from the elevator telephone port in response to an activation command. Also included is a supervisor port configured for connection to a supervisor telephone, means for detecting the activation command, means for facilitating a communication link between the elevator telephone port and the supervisor port in response to the activation command, and means for ringing an elevator telephone connected to the elevator telephone port.

In yet another aspect of the present invention, a device is provided for facilitating communications between an elevator passenger and a person outside of the elevator through use of an elevator telephone. The device includes a service port configured for connection to a telephone company feed line and an elevator telephone port configured for connection to an elevator telephone, wherein the elevator telephone port is selectively coupled with the service port. Also included is a supervisor port configured for connection to a supervisor telephone and a control circuit operatively coupled with the service port, the elevator telephone port and the supervisor port. The control circuit is configured to facilitate isolation of the service port from the elevator telephone port in response to an activation command, and to facilitate electrical coupling between the elevator telephone port and the supervisor port in response to the activation command. The control circuit is further configured to facilitate ringing of an elevator telephone connected to the elevator telephone port.

The present invention is advantageous for providing simple and inexpensive devices, systems and methods for enabling an existing elevator telephone to selectively facilitate voice communications between an elevator passenger and a person outside of the elevator without use of the telephone company feed line. The present invention is further advantageous in providing such devices, systems and methods that ensure that the elevator telephone retains access to the feed line while intercom communications are inactive. Additional aspects, advantages and novel features of the invention will be set forth in part in the description that follows, and in part will become apparent to those skilled in the art upon examination of the following or may be learned with the practice of the invention. The aspects and advantages of the invention may be realized and attained by means of the instrumentalities and combinations particularly pointed out in the appended claims.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF EXEMPLARY EMBODIMENTS

Figure 1:
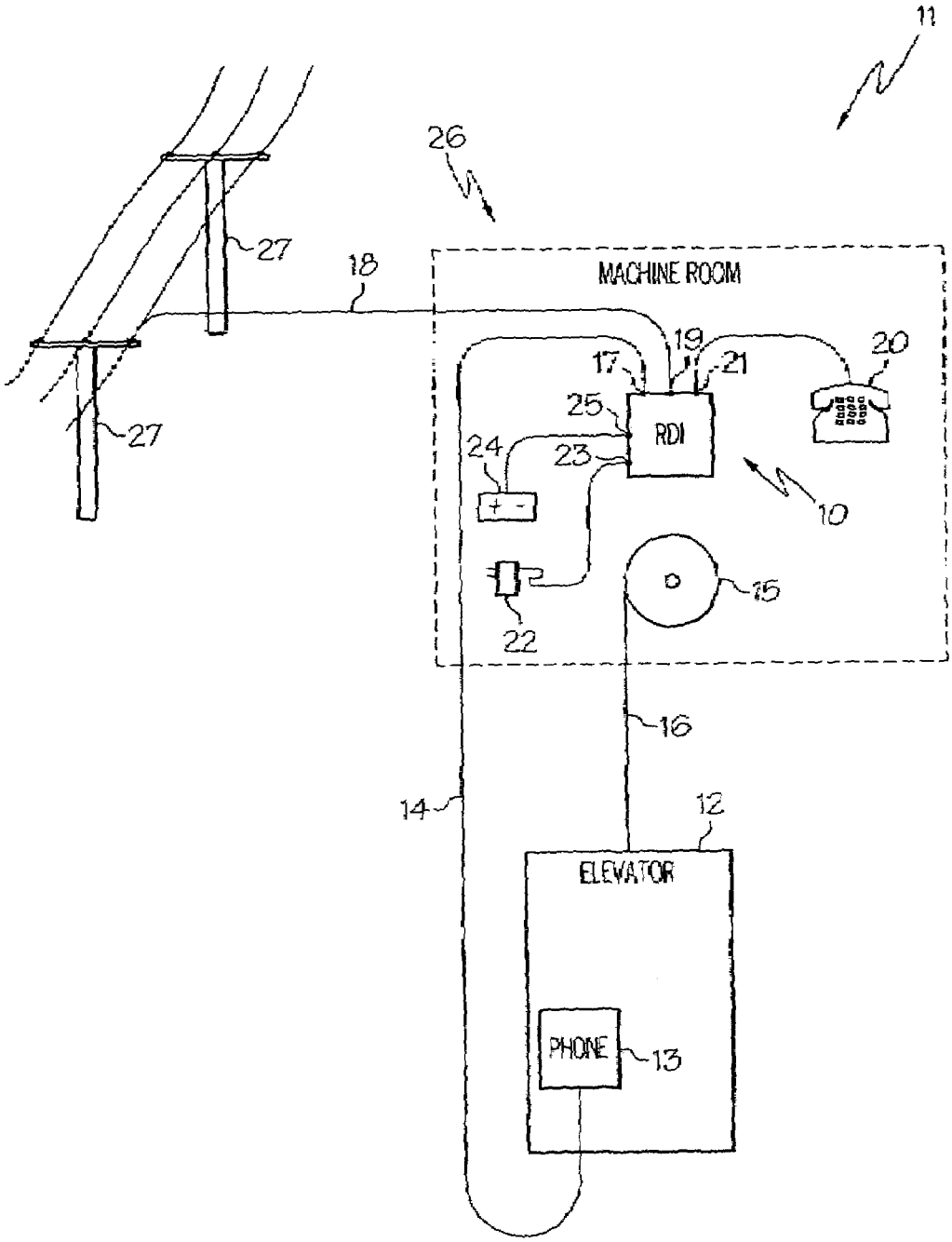
FIG. 1 is a partial block diagram schematically depicting an elevator system having a ring down intercom device in accordance with one exemplary embodiment of the present invention.

The present invention and its operation is hereinafter described in detail in connection with the views and examples of FIGS. 1–5 wherein like numbers indicate the same or corresponding elements throughout the views. As shown in FIG. 1, an elevator system 11 can include an elevator 12 connected by one or more overhead cables (e.g., 16) that interface an electromechanically driven drum 15 located in, for example, a machine room 26. Alternatively, the elevator might be supported by one or more underlying hydraulic cylinders (not shown).

Elevator 12 is shown to include an elevator telephone 13 that connects to one end of a flexible electrical cable 14. The other end of cable 14 can extend into machine room 26 where it interfaces an elevator telephone port 17 on a ring down intercom device 10 (hereinafter "RDI"), shown in FIGS. 1 and 2. It is to be understood however, that cable 14 can alternatively be replaced with a wireless connection, for example. In the exemplary embodiment shown, RDI 10 further comprises a service port 19 configured for connection to a feed line 18 from a telephone company (e.g., represented in FIG. 1 by utility poles 27). Although the feed line 18 is depicted as comprising a wired connection from RDI 10 to one or more utility poles 27, it is to be understood that the connection between RDI 10 and the telephone company could be a wireless connection (e.g., utilizing cellular telephone technology).

RDI 10 can further include a supervisor port 21 configured for connection to a microphone and/or a speaker of a microphone/speaker pair. As used herein, a microphone can comprise any device that generates electricity in response to sound waves. A speaker, as used herein, can comprise any device that generates sound waves in response to electricity. A microphone/speaker pair can comprise any combination of such a microphone and speaker, regardless of whether the microphone and speaker are disposed within a common enclosure or within separate enclosures. Examples of microphone/speaker pairs include telephones, telephone handsets, headphone/microphone combinations, and bookshelf speakers in combination with pedestal-type microphones. Regardless of its specific configuration, a microphone/speaker pair connected to supervisor port 21 can be used by a person outside of the elevator (e.g., a supervisor located in the elevator machine control room) to confer with an elevator passenger. In the embodiment depicted in FIG. 1, the microphone/speaker pair is shown to comprise a supervisor telephone 20 which interfaces supervisor port 21.

RDI 10 can include one or more ports for receiving operational power. In the example depicted in FIG. 1, RDI 10 is shown to include a power port 23 that is configured to receive power from a power supply (e.g., from a transformer 22 that interfaces a wall socket). An auxiliary power port 25 can also be provided as an interface to an alternate source of power (e.g., from a standby battery 24). RDI 10 might be configured to charge battery 24 through the auxiliary power port 25 while power is provided to RDI 10 through power port 23. In alternate embodiments, an RDI might not incorporate power ports and/or might comprise, for example, an internal power supply (e.g., a long-lasting battery), a power generation system (e.g., solar cells), or an internal battery/capacitor system configured to be recharged by power from feed line 18.

It is to be understood that each of the described ports (e.g., service port 19, elevator telephone port 17, supervisor port 21, power port 23 and auxiliary power port 25) can assume any of a variety of specific electrical and mechanical configurations. For example, a port might comprise a receptacle (e.g., for receiving modular telephone plugs). In another embodiment, a port might comprise screw terminals. As yet another example, a port can comprise a cable extending from RDI 10. In still another embodiment, in order to facilitate wireless communications as previously indicated, a port might comprise an antenna. In any event, all of the ports of a single RDI might have a similar configuration, or might alternatively have differing configurations. For example, in one embodiment, service port 19, elevator telephone port 17, and supervisor port 21 might each respectively comprise standard telephone jacks (e.g., as commonly found on household telephones), but power port 23 and auxiliary power port 25 might comprise screw terminals. In another embodiment, multiple ports might be provided integrally within a single connector, antenna or another suitable interface device.

Figure 2:
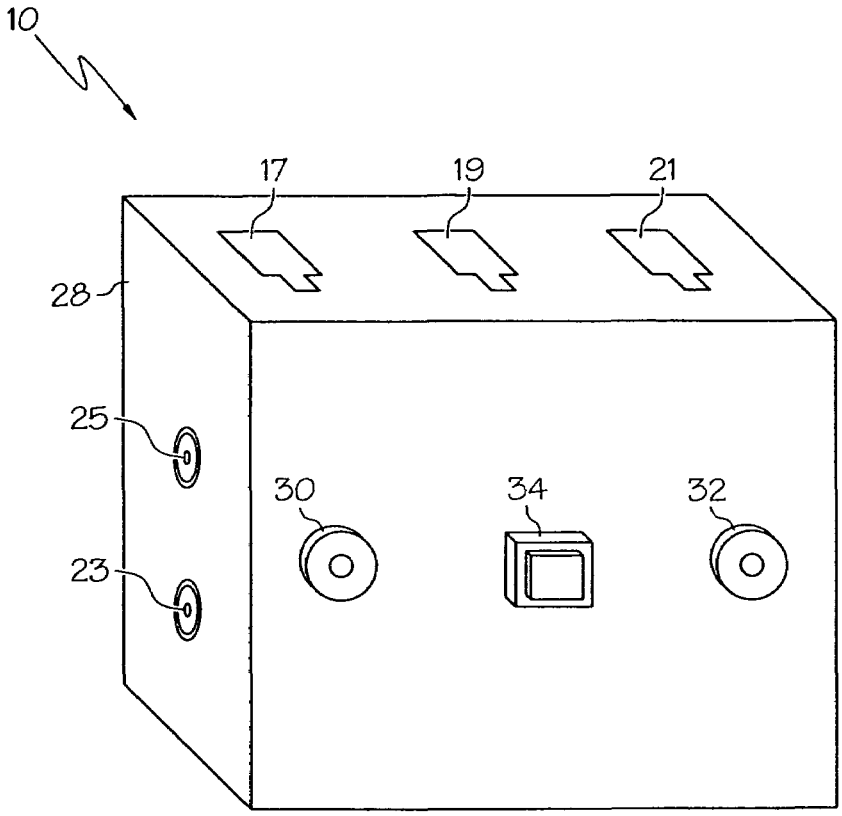
FIG. 2 is a front perspective view depicting the ring down intercom device of the exemplary embodiment of FIG. 1.

RDI 10 can comprise an enclosure 28 for supporting various components of RDI 10, including one or more ports (e.g., 17, 19, 21, 23 and 25), one or more actuators (e.g., pushbutton 34) one or more visual indicator devices (e.g., LED's 30 and 32), and/or additional electronic and/or electromechanical accessories of RDI 10 (e.g., audible indicator devices, such as a buzzer). However, it should be understood that the port(s), actuator(s), indicator device(s) and/or other accessories might alternatively be unsupported by the enclosure, such as when these devices are disposed external to and separate from enclosure 28, for example. Although enclosure 28 is depicted in FIGS. 1–2 as a substantially rectangular box having squared corners, alternate embodiments of an RDI enclosure can assume virtually any shape and can be formed of virtually any material (e.g., plastic, metal, epoxy, fiberglass). For example, in one alternate embodiment, the RDI can have an enclosure shaped like a conventional wall-type or desk-type telephone.

Figure 3:
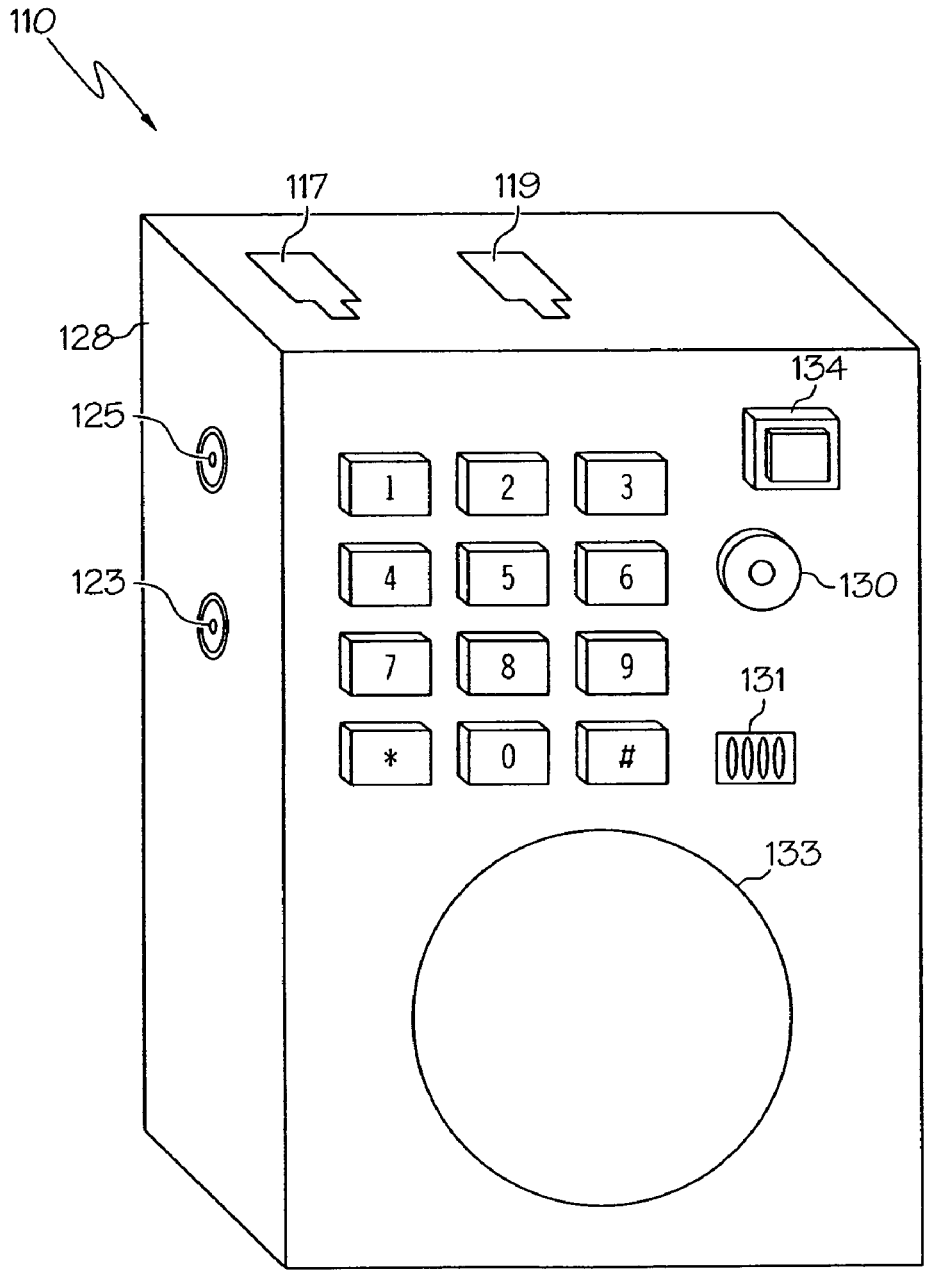
FIG. 3 is a front perspective view depicting another exemplary embodiment of a ring down intercom device in accordance with the present invention.

Turning now to FIG. 3, an alternate embodiment of an RDI 110 in accordance with the present invention is depicted. RDI 110 includes an enclosure 128 supporting an elevator telephone port 117, a service port 119, a power port 123 and an auxiliary power port 125. Such ports can be configured for connections similar to those described above with respect to corresponding ports of RDI 10 shown in FIGS. 1–2. Enclosure 128 also supports a keypad 129 (such as a Dual-Tone Multi-Frequency or DTMF keypad), an actuator (e.g., pushbutton 134) and one or more visual indicators (e.g., LED 130). In an alternate embodiment, an RDI having an integral keypad might not include an additional actuator (e.g., pushbutton 134) because one or more keys of keypad 129 might be configured to serve as the actuator. RDI 110 is further shown to integrate a microphone/speaker pair including a microphone 131 and a speaker 133. However, in an alternate embodiment, an RDI can integrate only one of the speaker and microphone of the microphone/speaker pair, and would accordingly comprise a supervisor port for connection to the other of the speaker and microphone of the microphone/speaker pair which is not integral with the RDI. In still a further embodiment, an RDI might not integrate either of the speaker or microphone of the microphone/speaker pair, and would accordingly comprise a supervisor port for connection to an external microphone/speaker pair.

Figure 4:
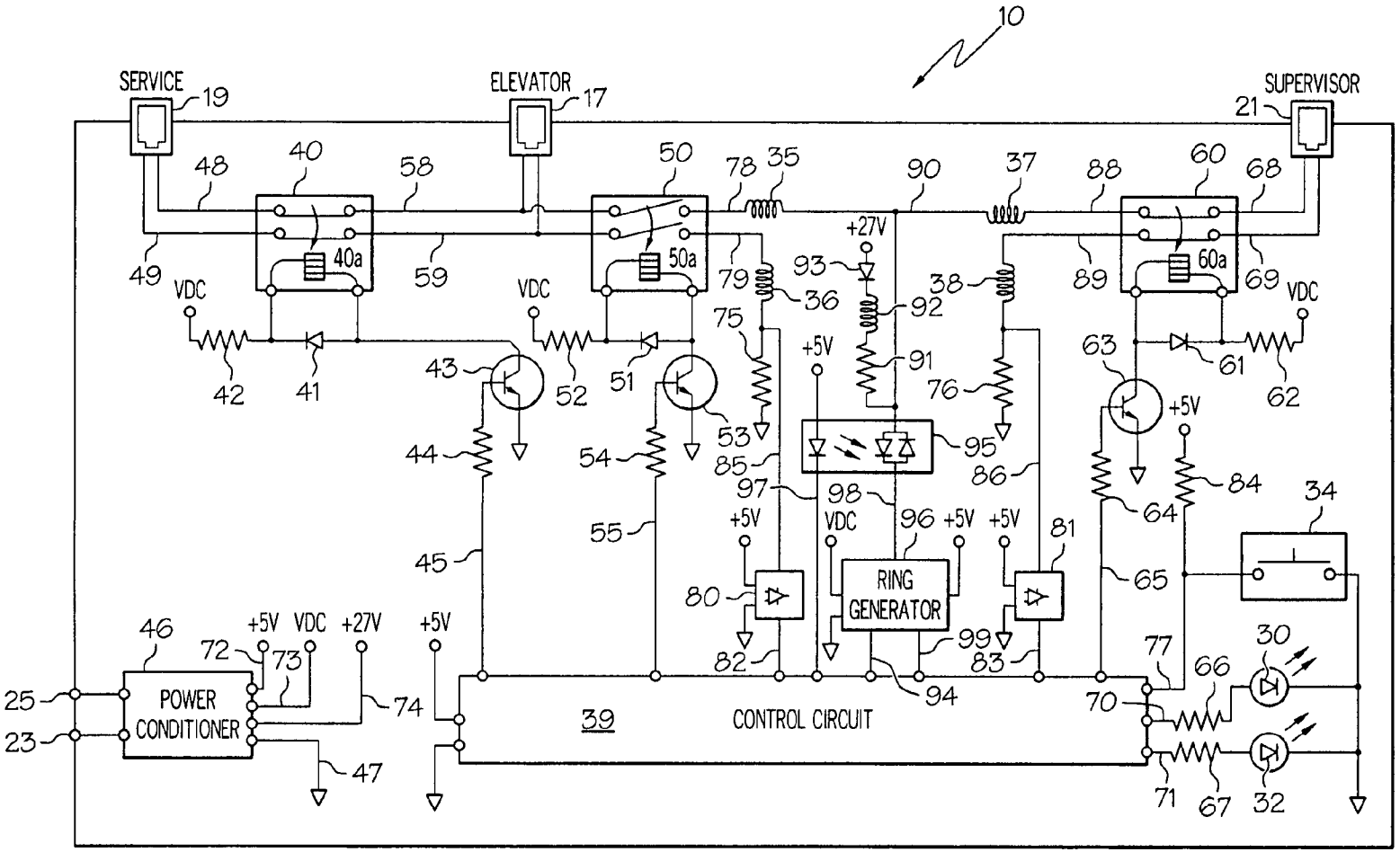
FIG. 4 is a simplified schematic view depicting the internal components of the ring down intercom device of FIGS. 1–2.

The schematic diagram of FIG. 4 depicts an exemplary circuit configuration that might be associated with RDI 10 of FIGS. 1–2. Power port 23 and auxiliary power port 25 are shown to interface a power conditioner 46. Power conditioner 46 can comprise a network of one or more voltage regulators, resistors, capacitors, switching power supplies, diodes, transformers and/or other electronic components. This network can provide one or more output voltages suitable to facilitate operation of RDI 10. In the exemplary configuration depicted in FIG. 4, power conditioner 46 is shown to provide three discrete power supplies. A first power supply 72 provides regulated 5 VDC with reference to a ground 47. A second power supply 73 provides approximately 12 VDC with reference to ground 47. A third power supply 74 provides approximately 27 VDC with reference to ground 47. It is of course to be understood that other embodiments of the present invention might involve differing configurations of power conditioner 46, wherein such differing configurations might include additional or fewer power supplies that are each configured to produce virtually any desirable voltage. In still other embodiments, separate power conditioners might be provided for each respective power supply.

RDI 10 can also include a control circuit 39 comprising one or more microcontrollers or other circuitry capable of facilitating the sequencing of signals required to implement the described functionality of RDI 10. Thus, control circuit 39 might in some embodiments include programmable software, for example. Such software might be loaded and/or adjusted by the manufacturer of the RDI, a user of the RDI, and/or a field service technician, for example. Examples of programmable parameters (many of which are described in further detail below) include delay times, timer durations, and ring cycle times.

Control circuit 39 can receive power from first power supply 72 and can connect with ground 47. Control circuit 39 can also interface any actuator(s) or indicator device(s) that might be used for interaction with an operator of RDI 10. For example, control circuit 39 is shown to interface first LED 30 through wire 70 and voltage limiting resistor 66. Also, control circuit 39 is shown to interface second LED 32 through wire 71 and voltage limiting resistor 67. Such LED's might reflect diagnostics, warnings, and/or other information that is important or otherwise helpful to an operator of RDI 10. As yet another example, control circuit 39 is shown to interface a pushbutton 34 through wire 77. As indicated, wire 77 also attaches to resistor 84 which is further tied to first power supply 72. In this configuration, the voltage on wire 77 might approximate that of first power supply 72 unless pushbutton 34 is depressed (during which depression wire 77 becomes connected with ground 47). It is certainly to be understood that the aforementioned configuration is merely exemplary, and that an RDI in accordance with the present invention can include virtually any number of actuators, indicator devices, ports and/or other such devices, and that such devices can be connected in any of a variety of configurations that will be apparent to those skilled in the art upon reading this disclosure.

Switches can be provided within RDI 10 for selectively connecting/isolating the feed line, the elevator telephone and the microphone/speaker pair. Although such switches are depicted in FIG. 4 as comprising relays (e.g., 40, 50 and 60), it should be understood that such switches can comprise any of a variety of suitable switching devices. For example, such switches might alternatively comprise manual switches (e.g., toggle switches, rotary switches, rocker switches, knife-type switches, etc.) or solid state switches (e.g., solid state relays, optic coupling devices, transistors, etc.).

Relay 40 is depicted in FIG. 4 as comprising two sets of normally closed contacts. By normally closed, it is to be understood that such contacts remain in the closed position (thereby enabling current flow) whenever the coil 40A of relay 40 is not energized. One side of each of the contacts of relay 40 respectively connects with wires 48 and 49 leading to service port 19. The other side of the contacts of relay 40 respectively connects to wires 58 and 59 which lead to elevator telephone port 17. When coil 40A is not energized (e.g., when RDI 10 is inactive, unpowered, or malfunctioning), the contacts of relay 40 remain closed, wires 48 and 49 maintain respective connections with wires 58 and 59, service port 19 resultantly remains coupled to elevator telephone port 17, and RDI 10 has no effect upon the elevator telephone's operation through the feed line. However, when coil 40A is energized (e.g., when RDI 10 is activated by an activation command from an operator), the contacts within relay 40 are opened, thereby isolating wire 48 from wire 58, isolating wire 49 from wire 59, and resultantly isolating service port 19 from elevator telephone port 17. Isolated, as used herein, means electrically disconnected and set apart, such that no current flows between the isolated devices during the presence of normal operating voltages.

Coil 40A is energized when control circuit 39 provides adequate voltage (e.g., about 5 VDC) upon wire 45. This voltage is reduced by resistor 44 and is applied to the base of transistor 43, thereby enabling current flow from the collector to the emitter of transistor 43. Once such current is facilitated through transistor 43, current from second power supply 73 passes through resistor 42 and coil 40A, thereby causing the contacts within relay 40 to open. A diode 41 can be provided to reduce electromagnetic interference that might otherwise result from coil 40A being energized.

Aside from connecting to elevator telephone port 17, wires 58 and 59 respectively connect to the first side of a pair of normally open contacts within relay 50. By normally open, it is to be understood that such contacts remain in the open position (thereby preventing current flow) whenever the coil 50A of relay 50 is not energized. The other side of the contacts of relay 50 respectively connect to wires 78 and 79. When coil 50A is not energized, the contacts within relay 50 are open, thereby isolating wire 58 from wire 78 and further isolating wire 59 from wire 79, and resultantly isolating elevator telephone port 17 from the RDI line. When coil 50A is energized, the contacts of relay 50 close, and wires 58 and 59 maintain connection with wires 78 and 79, respectively, thereby coupling elevator telephone port 17 to the RDI line. The RDI line, as discussed herein, refers to the portion of the RDI circuitry that applies power to elevator telephone port 17 and to supervisor port 21 after service port 19 has been disconnected. For example, portions of the RDI line relating to elevator telephone port 17 include, for example, wires 78 and 79. Also, portions of the RDI line relating to supervisor port 21 include, for example, wires 88 and 89. As discussed in greater detail below, current can be applied (e.g., when coil 50A is energized) to elevator telephone port 17 through wire 78 and this current can return to ground 47 from elevator telephone port 17 through wire 79. Also, current can be applied (e.g., when coil 60A is not energized) to supervisor port 21 through wire 88 and this current can return to ground 47 from supervisor port 21 through wire 89.

Coil 50A is energized when control circuit 39 provides adequate voltage (e.g., about 5 VDC) upon wire 55. This voltage is reduced by resistor 54 and is applied to the base of transistor 53, thereby enabling current flow from the collector to the emitter of transistor 53. Once such current is facilitated through transistor 53, current from second power supply 73 passes through resistor 52 and coil 50A, thereby causing the contacts within relay 50 to open. A diode 51 can be provided to reduce electromagnetic interference that might otherwise result from coil 50A being energized. In one alternate embodiment of the present invention, the contacts of relay 40 and relay 50 might be incorporated (e.g., as a double pole double throw switching arrangement) into a single relay or other switching device.

Wire 79 is shown as being connected through an inductor 36 and through a resistor 75 to ground 47. Inductor 36 can be provided to help prevent electromagnetic noise or other interference created by RDI 10 from being transmitted through relay 50 to elevator telephone port 17. A comparator circuit 80 couples with first power supply 72 and ground 47, and further connects with wire 85 to the interface between inductor 36 and resistor 75. Comparator circuit 80 monitors the voltage on wire 85 and provides a signal to control circuit 39 through wire 82. Resistor 75 serves to establish a reference voltage for comparator circuit 80 in order that comparator circuit 80 can measure the amount of current drawn through elevator telephone port 17. The amount of current drawn by an elevator telephone connected to elevator telephone port 17 can be indicative of whether the elevator telephone is off-hook (e.g., has answered an incoming call) or remains on-hook (e.g., has not yet answered an incoming call).

Wire 78 connects through inductor 35 to wire 90. Inductor 35 can be provided to help prevent electromagnetic noise or other interference created by RDI 10 from being transmitted through relay 50 to elevator telephone port 17. Wire 90 is shown as being connected (and thereby provided with power) through resistor 91, inductor 92, and diode 93 to third power supply 74. Diode 93 can be provided to prevent high voltages (e.g., caused by ringing) from damaging or otherwise interfering with third power supply 74. Inductor 92 prevents third power supply 74 from substantially interfering with AC signals that are imposed upon wire 90 by communications between an elevator telephone and a supervisor telephone, for example.

Wire 90 is also shown as being connected through inductor 37 to a first side of a first contact of relay 60. The first side of the second contact of relay 60 attaches with wire 89 to an inductor 38 and through a resistor 76 to ground 47. Inductors 37 and 38 are provided to help prevent electromagnetic noise or other interference created by RDI 10 from being transmitted through relay 60 to supervisor port 21. A comparator circuit 81 couples with first power supply 72 and ground 47, and further connects with wire 86 to the interface between inductor 38 and resistor 76. Comparator circuit 81 monitors the voltage on wire 86 and provides a signal to control circuit 39 through wire 83. Resistor 76 therefore serves to establish a reference voltage for comparator circuit 81 in order that comparator circuit 81 can measure the amount of current drawn through supervisor port 21. In this manner, if a supervisor telephone is connected with supervisor port 21, control circuit 39 can determine whether the handset of the supervisor telephone is on-hook or off-hook by continually monitoring the amount of current passing through the supervisor telephone.

In the embodiment depicted in FIG. 4, the first and second contacts of relay 60 are normally closed, such that when coil 60A of relay 60 is not energized, wires 88 and 89 respectively connect with wires 68 and 69 leading to supervisor port 21. Relay 60 becomes energized when control circuit 39 provides adequate voltage (e.g., about 5 VDC) upon wire 65. This voltage is reduced by resistor 64 and is applied to the base of transistor 63, thereby enabling current flow from the collector to the emitter of transistor 63. Once such current is facilitated through transistor 63, current from second power supply 73 passes through resistor 62 and coil 60A, thereby causing the contacts within relay 60 to open. A diode 61 can be provided to reduce electromagnetic interference that might otherwise result from coil 60A being energized.

Control circuit 39 connects with a ring generator circuit 96 through wires 94 and 99. Ring generator circuit 96 in one embodiment comprises a switched power supply, an oscillating circuit, and/or another circuit configuration capable of providing a high voltage AC signal suitable to ring one or more telephones. Ring generator circuit 96 receives power from first power supply 72 and second power supply 73, and also connects with ground 47. The output of ring generator circuit 96 passes through wire 98 to one of a pair of switched terminals of optic coupling device 95. The other switched terminal of optic coupling device 95 is shown as being coupled with wire 90. One of the switching terminals of optic coupling device 95 connects with first power supply 72. The other switching terminal of optic coupling device 95 connects to control circuit 39 with wire 97. When control circuit 39 connects wire 97 to ground 47, current can flow across the switched terminals of optic coupling device 95 such that a ring signal generated by ring generator circuit 96 can be imposed onto the RDI line, for example. However, when wire 97 is removed from ground 47 by control circuit 39, optic coupling device 95 prevents current flow across its switched terminals, and accordingly prevents rings from being imposed upon the RDI line.

It is of course to be understood that the foregoing circuit description merely provides certain exemplary configurations of an RDI in accordance with an embodiment of the present invention, and that many other circuit configurations (including different components and combinations thereof than those disclosed herein) will be apparent to those having ordinary skill in the art.

Figure 5A:
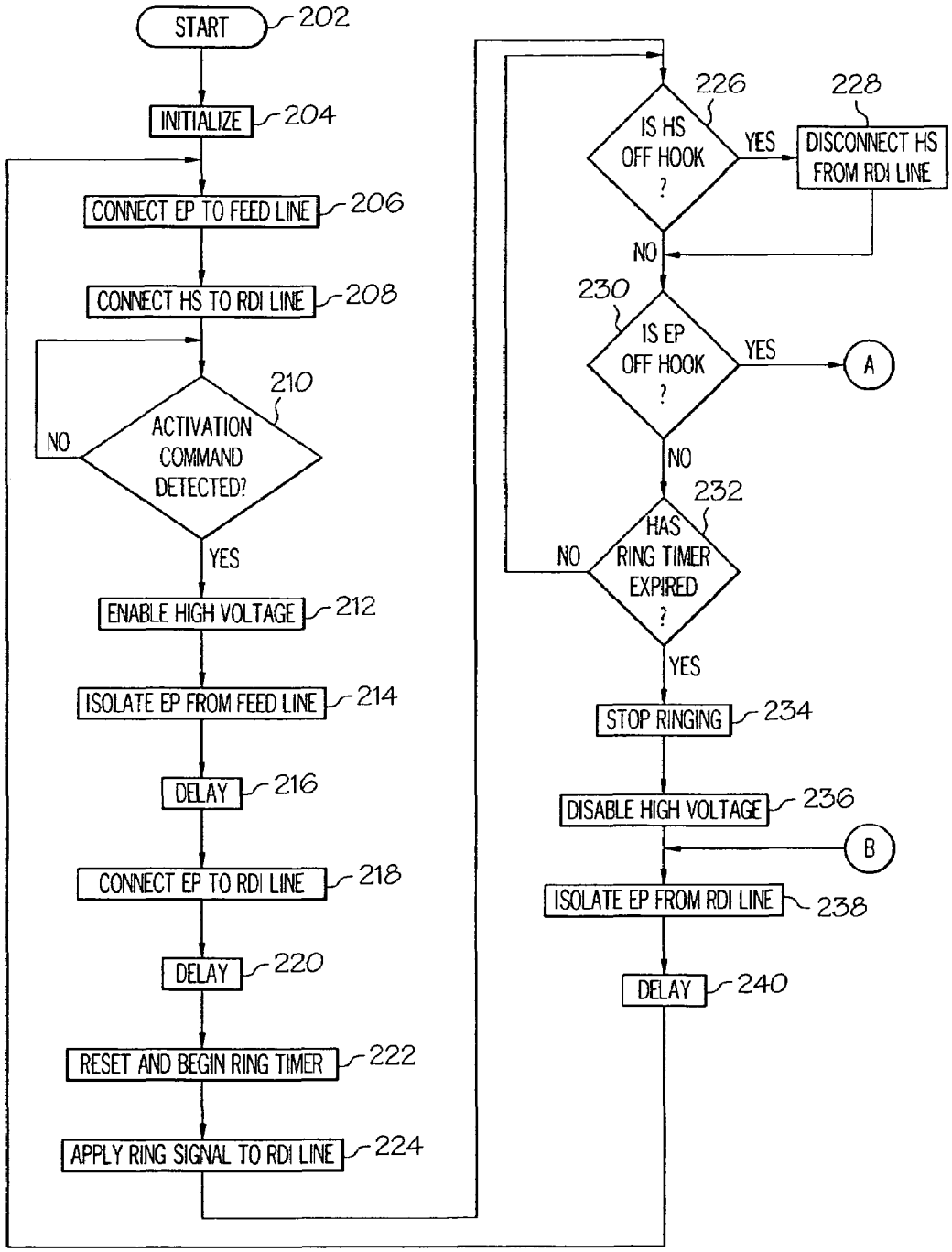
FIG. 5 is a flowchart depicting the operation of a ring down intercom device in accordance with one exemplary embodiment of the present invention.
Figure 5B:
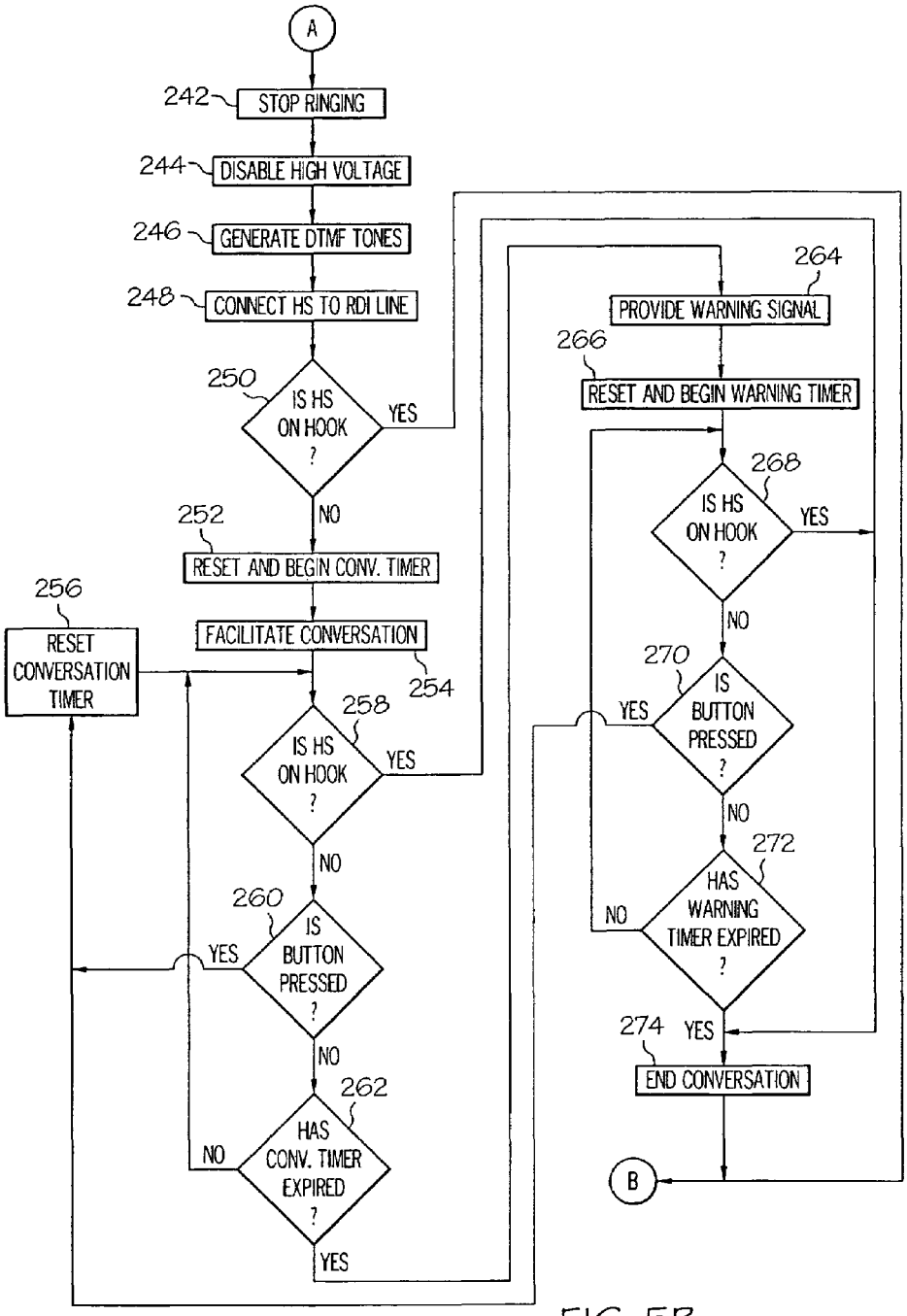

Turning now to FIG. 5, the detailed operation of one embodiment of the RDI (e.g., 10 of FIG. 1, 2, 4 or 110 of FIG. 3) will now be described. Power is applied to the RDI at step 202, and the device is initialized (e.g., the control circuit resets itself, loads data into memory and/or otherwise prepares itself to facilitate control of the RDI) at step 204. The elevator telephone (referred to as "EP" in FIG. 5) should already be connected (e.g., through the normally closed contacts of relay 40 depicted in FIG. 4, for example) to the feed line from the telephone company, but is connected at step 206 if such connection is not already facilitated. In one embodiment of the RDI, the microphone/speaker pair (hereinafter sometimes referred to as the handset of a supervisor telephone and referred to as "HS" in FIG. 5) is then connected to the RDI line (at step 208).

The control circuit then determines whether or not an activation command has been generated (step 210). Such an activation command can be detected on wire 77, for example, such as would reflect the depression of pushbutton 74. Alternatively, the activation command could be detected by sensing on wire 83 whether or not the handset of a supervisor telephone is off-hook. In an embodiment wherein the RDI includes an integral keypad, the activation command might be detected by monitoring wiring leading from the keypad to the control circuit. If no activation command is detected, the control circuit continually monitors for the activation command.

When the activation command is detected, the control circuit instructs the ring generator circuit 96 to begin generating high voltage (step 212), although this high voltage does not pass to the elevator telephone and/or the supervisor telephone until step 224 discussed below. At step 214, the elevator telephone is isolated from the feed line (e.g., by energizing coil 40A shown in FIG. 4). A delay (step 216) might then occur, thereby enabling the elevator telephone sufficient time to reset itself before interfacing with the RDI line. This delay period in one embodiment might be adjustably programmable, although in another embodiment might be an invariable characteristic of the RDI. At step 218, the elevator telephone is connected with the RDI line. Another delay (step 220) might then occur in order that the elevator telephone can stabilize after connecting with its new source of power (e.g., the RDI line). This delay might also be adjustably programmable or alternatively an invariable characteristic of the RDI.

The RDI then resets its ring timer (step 222) and selectively applies a ring signal to the RDI line (step 224) thereby causing at least one of the elevator telephone and/or the supervisor telephone to ring. The control circuit monitors (step 226) whether the handset of the supervisor telephone is off-hook (e.g., by checking the voltage on wire 83). If the handset is detected to be off-hook, the control circuit can disconnect the supervisor telephone from the RDI line (step 228), such as by energizing coil 60A shown in FIG. 4. This disconnection prevents damage to the supervisor telephone that could result if the supervisor telephone were to receive ringing voltage for an extended period of time while its handset is off-hook. If the handset of the supervisor telephone is on-hook, the control circuit determines (e.g., by checking the voltage on wire 82) whether the elevator telephone is off-hook (step 230). If the elevator telephone is on-hook, the control circuit then determines whether the ring timer has expired (step 232). If the ring timer has not expired, the ring signal is continually applied to the elevator telephone until such time as either the elevator telephone is answered (at step 230) or the timer expires. If the timer expires, the ringing is stopped (step 234), the high voltage is disabled (step 236), the elevator telephone is isolated from the RDI line (step 238), a delay results (step 240) before the elevator telephone is again connected to the feed line (step 206) and the handset of the supervisor telephone is connected (if not already) to the RDI line (step 208).

In the event that the elevator telephone is taken off-hook (step 230) during ringing, the ringing is stopped (step 242) and the high voltage power supply is disabled (step 244). The elevator telephone is typically configured to automatically answer any incoming calls after a certain number of rings, and will accordingly place itself off-hook after receiving the predetermined number of rings from the RDI. However, after answering an incoming call, certain elevator telephones require the entry of DTMF tones (e.g., for security purposes) before facilitating voice communication between the caller and the elevator passenger. Such tones might be provided, if required, at step 246 through use of a keypad on a supervisor telephone connected to the supervisor port or alternatively through use of a keypad integral with an RDI (e.g., keypad 129 of RDI 110 in FIG. 3). In an alternate embodiment of the RDI in accordance with the present invention, the RDI might be configured to automatically produce tones when (or shortly after) the elevator telephone answers. Such automatic provision of tones might be a programmable feature of the RDI, and might be selectively enabled by the manufacturer, the operator and/or field service personnel. However, as many elevator telephones do not require such codes, a DTMF keypad need not be provided or utilized in some applications of an RDI.

After an elevator telephone goes off-hook and any necessary DTMF codes have been entered, the RDI connects the handset to the RDI line (step 248). The control circuit then determines whether or not the handset is on-hook (step 250). If the handset is on-hook, the elevator telephone can be isolated from the RDI line (step 238), a delay occurs (step 240), the elevator telephone is connected to the feed line (step 206) and the handset is connected (if not already) to the RDI line (step 208). A subsequent activation command is then awaited (step 210). However, if the handset is off-hook (step 250) after being connected with the RDI line (step 248), a conversation timer is reset and started (step 252). A conversation is then facilitated (step 254) between an elevator passenger using the elevator telephone and a person outside of the elevator using a handset of the supervisor telephone.

The control circuit then monitors whether the handset is placed on-hook (step 258). If the handset is placed on-hook, the conversation ends (e.g., step 274). If the handset is not placed on-hook, the control circuit determines whether a reset button (e.g., 34 of FIGS. 2 and 4) has been pressed (step 260). In one embodiment of the present invention, the reset button might comprise the same button that is configured to provide the activation command. Alternatively, the reset button could comprise a separate actuator, one or more keypad depressions on a keypad, or a particular sequence of placing the handset on-hook. If the reset button is pressed at step 260, the conversation timer is reset (step 256) and the conversation is allowed to continue on. However, if the reset button is not pressed, the control circuit determines whether the conversation timer has expired (step 262). If the conversation timer has not expired, the conversation continues.

If the conversation timer does expire, a warning signal is provided (step 264). This warning signal might comprise an audible or visual warning signal generated by one or more components of the RDI. In one exemplary embodiment, such as depicted in FIGS. 1–4, such a warning signal could be provided through use of one more LED's (e.g., 30 and 32 of FIGS. 2 and 4). A warning timer then begins at step 266. If the handset is then placed on-hook (step 268) before the warning timer expires, the conversation ends (step 274). However, if the handset remains off-hook, the control circuit detects (step 270) whether a reset command has been provided (e.g., in one of the manners previously indicated). If a reset command has been provided, the conversation timer can be reset (step 256) and the conversation continues. However, if a reset command is not provided, the control circuit determines whether the warning timer has expired (step 272). If the warning timer has not expired, the conversation continues. If the warning timer expires, the conversation ends (step 274).

It should be appreciated that the method described above and depicted in FIG. 5 is merely exemplary for an RDI, and that accordingly those having ordinary skill in the art will appreciate that many variations of this method are within the scope of the claims appended hereto.

In one embodiment, the RDI can adjust the cycle times of rings provided from the RDI to the elevator telephone and/or to the supervisor telephone. In some instances, the specific ring cycle times might be a programmable aspect of the control circuit. More particularly, the control circuit can begin and end individual rings by activating and deactivating an optic coupling device (e.g., 95 in FIG. 4) disposed between the ring generator circuit and the RDI line, thereby selectively applying rings to the elevator telephone and/or the supervisor telephone. Such rings can have similar or different cycle times than are typically associated with rings generated by the telephone company (e.g., over the feed line). For example, a typical ring generated by the telephone company can include a ring cycle having an on-time of two seconds and an off-time of four seconds. If an RDI were to generate rings having such time durations, and if an associated elevator telephone were programmed to wait until the sixth ring to answer, it would take nearly thirty-two seconds for a supervisor to contact an elevator passenger through use of the RDI. However, the RDI can shorten the ring cycle so that multiple rings can be completed within a shorter time period. For example, control circuit 39 can be configured to generate rings having an on-time of one second and an off-time of two seconds. In this manner, an elevator telephone could recognize the same number of rings in half the time, and could therefore answer an incoming call from the RDI in considerably less time (e.g., sixteen seconds in the above example).

One benefit of the above-described RDI is that it can be easily installed into an existing elevator system having an elevator with an elevator telephone. In fact, such installation can typically be completed within a few minutes and simply involves the cutting of the feed line to the elevator telephone and the splicing of both ends of the feed line to the RDI. Installation can then be completed by connecting power and a supervisor telephone (in some embodiments) to the RDI. Operation of the RDI might then be customized through programming the RDI, if so desired.

Although the foregoing relates primarily to the association of an RDI with a single elevator telephone within a single elevator, it should be understood that an RDI in accordance with the present invention might also be configured to associate with a plurality of elevator telephones that are each located in respective elevators. Such an RDI could either sequentially interface each elevator telephone or could concurrently interface all associated elevator telephones.

The foregoing description of exemplary embodiments and examples of the invention has been presented for purposes of illustration and description. It is not intended to be exhaustive or to limit the invention to the forms described. Numerous modifications are possible in light of the above teachings. Some of those modifications have been discussed, and others will be understood by those skilled in the art. The embodiments were chosen and described in order to best illustrate the principles of the invention and various embodiments as are suited to the particular use contemplated. It is hereby intended that the scope of the invention be defined by the claims appended hereto.

What is claimed is:

1. A device for facilitating communications between an elevator passenger and a person outside of the elevator through use of an elevator telephone, the device comprising:

a service port configured for connection to a telephone company feed line;

an elevator telephone port configured for connection to an elevator telephone, wherein said elevator telephone port is selectively coupled with said service port through a first switch that is configured to isolate the service port from the elevator telephone port upon receiving a first signal;

a supervisor port configured for connection to a supervisor telephone;

a second switch configured to facilitate electrical coupling between the elevator telephone port and the supervisor port upon receiving a second signal;

a control circuit configured to provide the first and second signals in response to an activation command; and a ring circuit configured, as directed by the control circuit, to cause an elevator telephone connected to the elevator telephone port to ring.

2. The device of claim 1 further comprising a detection circuit configured to determine whether an elevator telephone connected to the elevator telephone port is off-hook, and to generate a corresponding answer signal for transmission to the control circuit, wherein the control circuit is operative to disable the ring circuit in response to the answer signal.

3. The device of claim 1 further comprising a power supply circuit for providing, as directed by the control circuit, electrical power to the elevator telephone port and to the supervisor port in order to facilitate voice communication between an elevator telephone connected to the elevator telephone port and a supervisor telephone connected to the supervisor port.

4. The device of claim 1 wherein the first switch comprises a relay configured to selectively isolate the service port from the elevator telephone port.

5. The device of claim 4 wherein the second switch comprises a relay configured to selectively connect the elevator telephone port to the RDI line.

6. The device of claim 4 wherein the second switch comprises a relay configured to selectively disconnect the supervisor port from the RDI line.

7. The device of claim 5 wherein the first and second switches are integrated within a common relay.

8. The device of claim 1 further comprising a detection circuit configured to determine whether a handset of a supervisor telephone connected to the supervisor port is off-hook, the detection circuit being operative to generate an off-hook signal for transmission to the control circuit.

9. The device of claim 8 wherein the off-hook signal is the activation command.

10. The device of claim 1 further comprising an actuator configured to cause the generation of the activation command.

11. The device of claim 1 further configured to generate rings having a shortened cycle time.

12. The device of claim 11 further comprising a DTMF keypad and a corresponding tone generator circuit.

13. The device of claim 1 wherein the control circuit comprises at least one microcontroller.

14. A device for facilitating communications between an elevator passenger at an elevator telephone and a person outside of the elevator at a microphone/speaker pair, the device comprising:

a service port configured for connection to a telephone company feed line;

an elevator telephone port configured for connection to an elevator telephone, wherein said elevator telephone port is selectively coupled with said service port by a first switch that is configured to isolate the service port from the elevator telephone port upon receiving a first signal;

a second switch configured to facilitate electrical coupling between the elevator telephone port and a microphone/speaker pair upon receiving a second signal;

a control circuit configured to provide the first and second signals in response to an activation command; and a ring circuit configured, as directed by the control circuit, to generate a ring signal for ringing an elevator telephone connected to the elevator telephone port.

15. The device of claim 14 further comprising a detection circuit configured to determine whether an elevator telephone connected to the elevator telephone port is off-hook, and to generate a corresponding answer signal for transmission to the control circuit, wherein the control circuit is operative to disable the ring circuit in response to the answer signal.

16. The device of claim 14 further comprising a power supply circuit for providing, as directed by the control circuit, electrical power to the elevator telephone port in order to facilitate voice communication between a microphone/speaker pair and an elevator telephone connected to the elevator telephone port.

17. The device of claim 14 further comprising at least one of a microphone and a speaker of a microphone/speaker pair.

18. The device of claim 17 further comprising both a microphone and a speaker of a microphone/speaker pair.

19. The device of claim 14 further comprising a supervisor port configured for connection with at least one of a microphone and a speaker of a microphone/speaker pair.

20. The device of claim 19 further comprising a supervisor port configured for connection with both a microphone and a speaker of a microphone/speaker pair.

21. The device of claim 20 wherein the supervisor port is configured for connection with a supervisor telephone having a microphone/speaker pair.

22. The device of claim 14 further comprising a DTMF keypad and a corresponding tone generator circuit.

23. The device of claim 14 further comprising an actuator configured to cause the generation of the activation command.

24. The device of claim 14 further configured to generate rings having a shortened cycle time.

25. The device of claim 14 wherein the control circuit is configured to simultaneously provide the first and second signals.

26. The device of claim 14 wherein the control circuit is configured to sequentially provide the first and second signals with an intervening delay.

27. An elevator system comprising an elevator having a telephone selectively connected to a telephone company feed line through a communication device, the communication device further connected to a supervisor telephone and including:

a first switch configured to electrically isolate the elevator telephone from the feed line upon receiving a first signal;

a second switch configured to facilitate electrical coupling between the elevator telephone and the supervisor telephone upon receiving a second signal;

a control circuit configured to provide the first and second signals in response to an activation command; and a ring circuit configured, as directed by the control circuit, to cause the elevator telephone to ring.

28. The device of claim 27 further comprising a detection circuit configured to determine whether the elevator telephone is off-hook, and to generate a corresponding answer signal for transmission to the control circuit, wherein the control circuit is operative to disable the ring circuit in response to the answer signal.

29. The device of claim 27 further comprising a power supply circuit for providing, as directed by the control circuit, electrical power to the elevator telephone and the supervisor telephone in order to facilitate voice communication therebetween.

30. A method for facilitating communications between an elevator passenger and a person outside of the elevator through use of an elevator telephone, the elevator telephone connected to a telephone company feed line, the method comprising:

receiving an activation command from the person outside of the elevator;

isolating the elevator telephone from the feed line in response to the activation command;

connecting the elevator telephone with an RDI line in response to the activation command; and providing a ring signal to the elevator telephone over the RDI line upon connection of the elevator telephone with the RDI line.

31. The method of claim 30 further comprising the step of detecting the answering of the elevator telephone, in response to which the ring signal is no longer provided.

32. The method of claim 30 further comprising the step of providing power to the elevator telephone from the RDI line in order to facilitate voice communication between the elevator passenger and the person outside of the elevator.

33. A device for facilitating communications between an elevator passenger and a person outside of the elevator through use of an elevator telephone, the device comprising:

a service port configured for connection to a telephone company feed line;

an elevator telephone port configured for connection to an elevator telephone, wherein said elevator telephone port is selectively electrically coupled with said service port through a means for isolating the service port from the elevator telephone port in response to an activation command;

a supervisor port configured for connection to a supervisor telephone;

means for detecting the activation command;

means for facilitating a communication link between the elevator telephone port and the supervisor port in response to the activation command; and means for ringing an elevator telephone connected to the elevator telephone port.

34. The device of claim 32 wherein the means for isolating comprises a relay.

35. The device of claim 34 wherein the means for facilitating comprises the relay.

36. The device of claim 32 wherein the means for facilitating comprises at least one relay.

37. A device for facilitating communications between an elevator passenger and a person outside of the elevator through use of an elevator telephone, the device comprising:

a service port configured for connection to a telephone company feed line;

an elevator telephone port configured for connection to an elevator telephone, wherein said elevator telephone port is selectively coupled with said service port;

a supervisor port configured for connection to a supervisor telephone; and a control circuit operatively coupled with the service port, the elevator telephone port and the supervisor port, the control circuit configured to facilitate isolation of the service port from the elevator telephone port in response to an activation command, and to facilitate electrical coupling between the elevator telephone port and the supervisor port in response to the activation command, wherein the control circuit is further configured to facilitate ringing of an elevator telephone connected to the elevator telephone port.

38. The device of claim 32 further comprising means for detecting the answering of an elevator telephone connected to the elevator telephone port.

* * * * *

UNITED STATES PATENT AND TRADEMARK OFFICE

CERTIFICATE OF CORRECTION

PATENT NO. : 6,971,480 B2
APPLICATION NO. : 10/652865
DATED : December 6, 2005
INVENTOR(S) : Victor Trifu It is certified that error appears in the above-identified patent and that said Letters Patent is hereby corrected as shown below:

Claim 34, column 16, line 9, change “32” to --33--.

Claim 36, column 16, line 13, change “32” to --33--.

Claim 38, column 16, line 35, change “32” to --33--.

Signed and Sealed this

Twenty-ninth Day of January, 2008

JON W. DUDAS
*Director of the United States Patent and Trademark Office*